US010232221B1

(12) United States Patent
Grayston

(10) Patent No.: US 10,232,221 B1
(45) Date of Patent: Mar. 19, 2019

(54) SPRING-LOADED BOOT

(71) Applicant: Daniel Grayston, Vancouver (CA)

(72) Inventor: Daniel Grayston, Vancouver (CA)

(73) Assignee: Daniel Grayston, Vancouver, BC (CA)

( * ) Notice: Subject to any disclaimer, the term of this patent is extended or adjusted under 35 U.S.C. 154(b) by 0 days.

(21) Appl. No.: 15/730,370

(22) Filed: Oct. 11, 2017

(51) Int. Cl.
*A43B 13/18* (2006.01)
*A63B 25/10* (2006.01)
*A43B 5/04* (2006.01)

(52) U.S. Cl.
CPC ..... *A63B 25/10* (2013.01); *A43B 13/182* (2013.01); *A43B 13/184* (2013.01); *A43B 13/185* (2013.01); *A43B 5/0417* (2013.01)

(58) Field of Classification Search
CPC ... A43B 13/182; A43B 13/184; A43B 13/185; A63B 25/10
USPC ..... 36/7.8
See application file for complete search history.

(56) References Cited

U.S. PATENT DOCUMENTS 413,693 A * 10/1889 Walker ..... A43B 13/182 36/28
1,331,952 A 2/1920 Brant
1,597,792 A * 8/1926 Hoff ..... A63B 25/10 184/105.1
2,345,085 A * 3/1944 Albert ..... A63B 25/10 244/1 R
3,875,888 A 4/1975 McNaughton
4,133,086 A * 1/1979 Brennan ..... A43B 5/18 36/7.8
4,196,903 A * 4/1980 Illustrato ..... A43B 13/182 36/7.8
4,457,084 A * 7/1984 Horibata ..... A43B 5/12 36/28
D307,608 S * 5/1990 Shure ..... D2/946
6,436,012 B1 * 8/2002 Naville ..... A43B 5/00 36/114
8,272,146 B1 9/2012 Jackson
9,021,719 B2 5/2015 Rabushka

* cited by examiner

*Primary Examiner* — Ted Kavanaugh

(57) ABSTRACT

Disclosed is a spring-loaded boot. The invention consists of a rigid boot bound to a set of plates, with shock absorbers situated on each end of, and sandwiched between, the plates. The top plate provides the platform for binding a ski boot, and the bottom plate provides ground contact and traction. The device allows the user to bounce with pogo-like motion. The rigid shell of the boot provides the ample ankle support and protection needed for rugged terrain.

1 Claim, 1 Drawing Sheet

SPRING-LOADED BOOT

FIELD OF THE INVENTION

This invention relates to modified footwear, specifically to footwear fitted with springs for bouncing, and more particularly to footwear fitted with springs for traversing rough terrain.

BACKGROUND OF THE INVENTION

The following is a tabulation of some prior art that appears relevant:

| U.S. Patents | | | |
|---|---|---|---|
| Pat. No. | Kind Code | Issue Date | Patentee |
| 9,021,719 | B2 | 2015 May 5 | Rabushka |
| 3,875,888 | | 1975 Apr. 8 | McNaughton |
| 1,331,952 | A | 1920 Feb. 24 | Brant |
| 8,272,146 | B1 | 2012 Sep. 25 | Jackson |
| **U.S. patent application Publications** | | | |
| Publication Nr. | Kind Code | Publ. Date | Applicant |
| 20060086006 | A1 | 2006 Apr. 27 | Forrest |
| **Foreign Patent Documents** | | | |
| Foreign Doc. Nr. | Cntry Code | Kind Code | App or Patentee |
| 0284070 | EP | A2 | Giljohann |

Spring action footwear is an amalgam of various fields. On one end of the spectrum, shock cushioning technology provides shock absorption for runners and skiers, and on the other end, it offers propulsion, allowing the user to literally bounce pogo stick style. Mild shock absorption usually relies on elastics sandwiched between semi-rigid platforms. Rabushka, U.S. Pat. No. 9,021,719 B2 discloses semi-rigid inner and outer soles situated in a see-saw configuration, the outsole providing a mid-point fulcrum, with elastic filler in the heel and toe regions. Greater shock absorption is provided by springs, which are used when the movement involves heightened impact, such as in skiing. Giljohann, EP 0284070 A2 discloses a ski boot with a series of vertical springs compressed between the boot's inner and outer soles. Forrest, U.S. Pat. App. No. US 2006/0086006 A1, uses strategically positioned, cylinder style shock absorbers, in an exoskeleton surrounding a ski boot. Then there is bouncing footwear, which not only cushions impact, it adds substantial rebound energy, enough to propel the wearer off the ground. Brant, U.S. Pat. No. 1,331,952 and McNaughton, U.S. Pat. No. 3,875,688 disclose a shoe with a single, large spring connected to the sole. Jackson, U.S. Pat. No. 8,272,146 B1, discloses multiple hydraulic springs sandwiched between a shoe and surface platform.

SUMMARY OF THE INVENTION

This invention is footwear which allows the user to bounce across rugged terrain while providing the necessary ankle support and protection to avoid injury, essentially a spring-loaded ski boot. In its essence, the invention comprises a rigid boot mounted on an assembly of plates and shock absorbers. There is a top plate which binds the boot, and a bottom plate which makes ground contact, with the shock absorbers in-between the plates. Because the boot has a hard, outer shell which covers, protects, and supports the ankle, the device particularly well suited for use in rugged terrain.

DETAILED DESCRIPTION OF INVENTION

Figure 1:
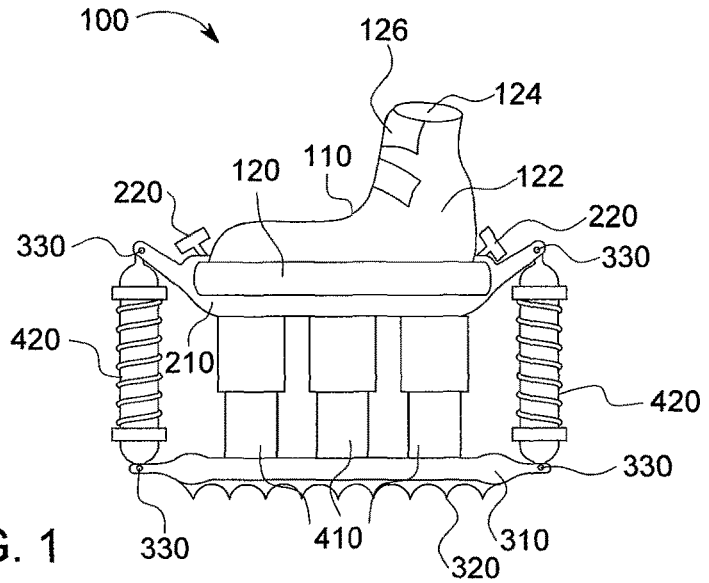
FIG. 1 is a view of the invention from the side.

The invention is best understood by reference to the drawings. As shown in FIG. 1 the spring-loaded ski boot 100 comprises a boot component 110 which resembles a standard ski boot. Such boots are well known to one of ordinary skill in the art. The boot component 110 comprises a sole 120, a top 122, a foot hole 124, and a binding means 126 such as buckles (shown here) or laces. The top 122 comprises a semi-rigid shell and soft inner cushioning which extends over and beyond the ankle for protection and support.

There is a mounting plate 210, comprising a top surface, a bottom surface, a front end, and a back end. On the front end and the back end of the mounting plate are ski boot binding means 220 for binding the boot to the top plate. Such binding means are well known to one of ordinary skill in the art. There is a base plate 310, comprising a top surface, a bottom surface, a front end, and a back end. The bottom surface of the base plate has a ridge set 320 comprising a pattern of ridges for traction. There is a strut mount set 330, comprising an elongated structure with at least one hole for the insertion of a nut and bolt or other joining means, and extending from each of the front and back ends of the mounting and base plates.

There is a small shock absorber assembly 410 joining the bottom of the mounting plate and the top of the base plate. Such shock absorbers are well known to one of ordinary skill in the art. The small shock absorber assembly comprises at least one shock absorber. If more than one shock absorber is used, the shock absorbers are arranged along the longitudinal axis of the mounting plate and the base plate.

There is a large shock absorber assembly 420 joining the mounting and base plates to the strut mount set 330. Such shock absorbers are well known to one of ordinary skill in the art.

Figure 2:
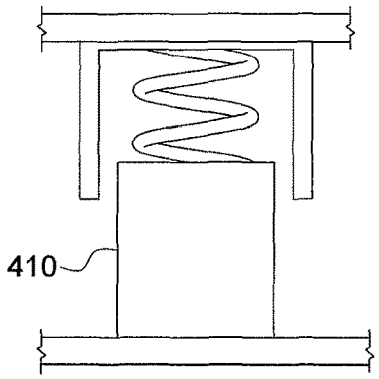
FIG. 2 is an isolated view of a shock absorber from the small shock absorber assembly.

Referring now to FIG. 2, each shock absorber 410 in the small shock absorber assembly has a diameter substantially that of the width of the bottom surface of the mounting plate and the top surface of the base plate, and is welded or otherwise reliably joined to the respective plates.

Figure 3:
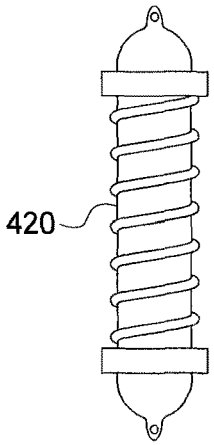
FIG. 3 is an isolated view of a shock absorber from the large shock absorber assembly.

Referring now to FIG. 3, each shock absorber in the large shock absorber assembly 420 is attached to the strut mount set by nuts and bolts, or other reliable connection means, at the front and back ends of the mounting and base plates.

I claim:

1. A spring-loaded boot, comprising (a) a boot component, comprising a sole, a top, and a foot hole, the top comprising an elongated rigid outer shell;

(b) a mounting plate, comprising a generally flat rectangular structure having a top surface, a bottom surface, a front end, and a back end;

(c) a binding means for securing the boot component to the mounting plate;

(d) a base plate, comprising a generally flat rectangular structure having a top surface, a bottom surface, a front end, and a back end;

(e) a small shock absorber assembly, comprising at least one shock absorber situated between and connecting the mounting plate and the base plate;

(f) a strut mount set, comprising an elongated structure with at least one hole, extending from each of the front and back ends of the mounting plate and the base plate;

(g) a large shock absorber assembly, comprising at least two shock absorbers attached to the strut mount set at the front and back ends of the mounting and base plates;

(h) a ridge set, comprising a pattern of ridges on the bottom surface of the base plate.

* * * * *